US008079502B2

(12) United States Patent
Montgomery

(10) Patent No.: US 8,079,502 B2
(45) Date of Patent: Dec. 20, 2011

(54) SACK

(75) Inventor: Andrew Montgomery, Australian Capital Territory (AU)

(73) Assignee: Mont Adventure Equipment Pty Ltd. (AU)

( * ) Notice: Subject to any disclaimer, the term of this patent is extended or adjusted under 35 U.S.C. 154(b) by 471 days.

(21) Appl. No.: 10/595,808

(22) PCT Filed: Nov. 12, 2004

(86) PCT No.: PCT/AU2004/001554

§ 371 (c)(1),
(2), (4) Date: May 12, 2006

(87) PCT Pub. No.: WO2005/046383

PCT Pub. Date: May 26, 2005

(65) Prior Publication Data

US 2008/0212902 A1 Sep. 4, 2008

(30) Foreign Application Priority Data

Nov. 13, 2003 (AU) ..... 2003906242

(51) Int. Cl.
*A45F 3/04* (2006.01)

(52) U.S. Cl. ..... 224/627; 224/579; 224/645; 383/2

(58) Field of Classification Search ..... 224/627, 224/259, 578, 579, 575, 580, 628, 637, 639, 224/645, 652; 383/2
See application file for complete search history.

(56) References Cited

U.S. PATENT DOCUMENTS

| | | | | |
|---|---|---|---|---|
| 4,267,868 | A | 5/1981 | Lowe | |
| 5,125,547 | A * | 6/1992 | Russell | 224/637 |
| 5,957,355 | A * | 9/1999 | Swetish | 224/627 |
| 6,024,265 | A * | 2/2000 | Clements | 224/630 |
| 6,089,752 | A * | 7/2000 | Moore | 383/2 |
| 6,325,262 | B1 * | 12/2001 | Thompson | 224/628 |
| 7,083,331 | B2 * | 8/2006 | Nykoluk | 383/2 |

FOREIGN PATENT DOCUMENTS

| | | |
|---|---|---|
| GB | 2128076 A | 4/1984 |
| SU | 1482861 A | 5/1989 |

* cited by examiner

*Primary Examiner* — Nathan J Newhouse
*Assistant Examiner* — Corey Skurdal
(74) *Attorney, Agent, or Firm* — Brooks Kushman P.C.

(57) ABSTRACT

A sack for compressing compressible material contained therein, the sack including: a pliable body portion (20) for receiving the material, the body portion having a lower base portion (22), wall means (21) and an upper opening (23) for introducing the material into the sack and removing it therefrom; cover means (28) exterior to the body portion and fixed thereto proximate the opening and having cover fastening means (29, 30, 31, 32) for releasably fastening to the body portion proximate the base whereby the cover means covers the opening, and a plurality of straps (25, 26) and/or connectors exterior to the body portion and attached thereto; wherein the cover fastening means and the plurality of straps and/or connectors are operable to compress material in the body portion.

6 Claims, 5 Drawing Sheets

SACK

TECHNICAL FIELD

This invention relates to a sack.

As used herein the expression "sack" is to be given a broad meaning including any form of container made from a pliable material and adapted to hold articles, objects, material etc.

The invention has particular application to a sack adapted to compress the contents therein. Such sacks are known as compression sacks. The invention has even more particular application to a compression sack adapted to be carried on the back as a rucksack or backpack.

A particularly preferred embodiment of the invention is a so-called compression stuff sack used to hold a sleeping bag. In one embodiment this can be converted for use as a lightweight backpack, often called a day pack, which is useful for short daily excursions when on a longer walking or camping trip.

BACKGROUND OF INVENTION

On such walking or camping trips, particularly ones of lengthy duration, it is important that both the weight to be carried, and the space occupied by the contents of the main backpack, is minimized. It is well known for sleeping bags, which in use are quite bulky, to be compressed by stuffing into a so-called stuff sack and for the sack to be further compressed by use of a number of pull straps attached to one end of the sack and which engage with locking clips attached to the other end.

Such a known compression stuff sack is illustrated in U.S. Pat. No. 4,267,868, FIG. 1 of which, for convenience, is reproduced as FIG. 1 in the illustrations of the present specification. Pull straps 10 attached to the top of cylindrical sack 11 at 12 are radially disposed about the periphery of sack 11 (two of four such pull straps can be seen in FIG. 1). Straps 10 are fed through a return anchor buckle 13 attached to the base of sack 11 at 14. In known bags, a flap 15 is disposed within the upper opening of sack 11 and a pull cord 16 with locking toggle 17 allows the stuff sack to be closed in known manner.

SUMMARY OF INVENTION

The present invention aims to provide an alternative to known sacks.

This invention in one aspect resides broadly in a sack for compressing compressible material contained therein, the sack including:— a pliable body portion for receiving the material, the body portion having a lower base portion, wall means and an upper opening for introducing the material into the sack and removing it therefrom;

cover means exterior to the body portion and fixed thereto proximate the opening and having cover fastening means for releasably fastening to the body portion proximate the base whereby the cover means covers the opening, and a plurality of straps and/or connectors exterior to the body portion and attached thereto;

wherein the cover fastening means and the plurality of straps and/or connectors are operable to compress material in the body portion.

In a preferred embodiment of this aspect of the invention the sack may also include shoulder straps cooperable with another or others of the plurality of straps and/or connectors whereby the sack constitutes a backpack.

Accordingly in another aspect this invention resides broadly in a backpack including:— a pliable body portion having a lower base portion, wall means and an upper opening for introducing material into the backpack and removing it therefrom;

cover means exterior to the body portion and fixed thereto proximate the opening and having cover fastening means for releasably fastening to the body portion proximate the base whereby the cover means covers the opening;

a plurality of straps and/or connectors exterior to the body portion and attached thereto, and shoulder straps fixed to the body portion proximate the opening, the shoulder straps cooperating in use with at least one of the plurality of straps and/or connectors and being stowable when not in use;

wherein the cover fastening means and the plurality of straps and/or connectors are operable to compress compressible material in the body portion.

It is preferred that the upper portion of the wall means constitutes the opening and includes a drawstring for the opening.

It is also preferred that the body portion is shaped to be substantially cylindrical and extending along a central axis when full and that the cover means is cap-like and adapted to cover and extend below the opening when the cover fastening means is fastened to the body portion.

It is also preferred that the sack includes a porous pliable panel member between the shoulder straps juxtaposing the wall means and attached thereto to constitute a sleeve on the back of the back pack, whereby when used as a backpack the panel constitutes a breathable barrier between the user's back and the backpack with the sleeve being adapted to stow a stiffening member and/or hydration bladder, and when not used as a backpack the sleeve is adapted to optionally stow the shoulder straps.

DESCRIPTION OF DRAWINGS

In order that this invention may be more easily understood and put into practical effect, reference will now be made to the accompanying drawings which illustrate a preferred embodiment of the invention, wherein:—

DESCRIPTION OF PREFERRED EMBODIMENT OF INVENTION

Figure 1:
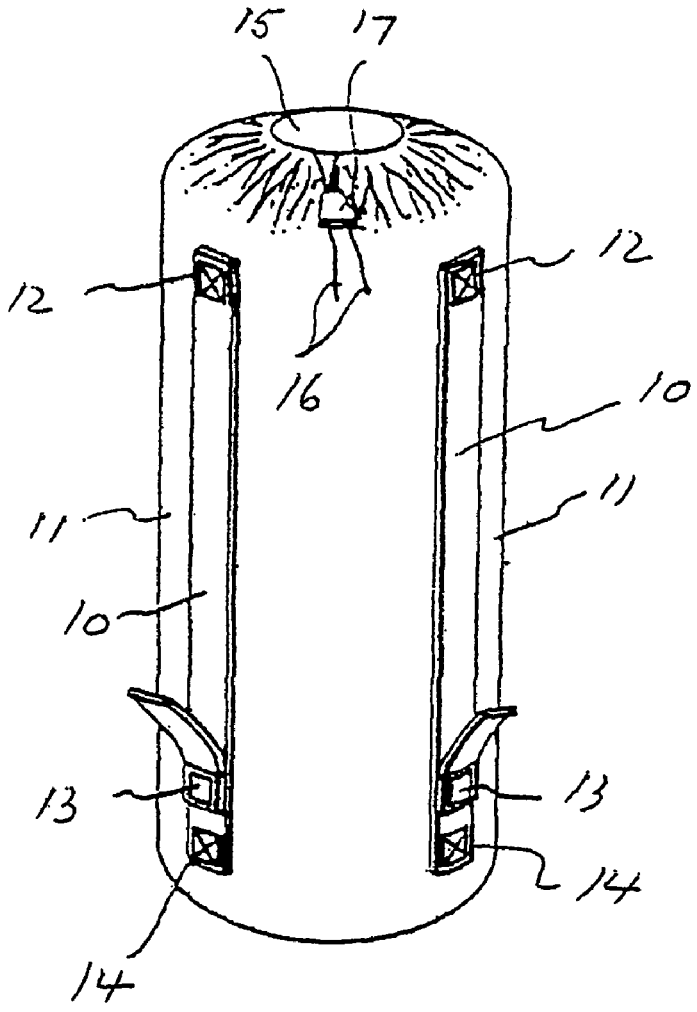
FIG 1 PRIOR ART
FIG. 1 shows the perspective view of a compression stuff sack of the prior art.

As seen in the illustrations, the sack of the present invention has a pliable body 20 with a side walling 21 extending from a base 22 to define an opening 23 which can be drawn closed by drawstring 24. Compression straps 25 are attached at 27 to body 20 proximate base 22 and feed through friction binding return-loop buckles 26 in known manner. A cap-like cover 28 is fixed to the upper portion of side walling 21 between buckles 26 so as to cover opening 23 when drawn over the opening. Cover 28 is similar to known backpack top covers and has a female socket 29 for receiving the pronged friction binding return-loop clip 32, through which passes strap 30 which is fixed at 31 to body 20 proximate base 22. Strap 30 thus serves both to close cover 28 over the sack and to act as a compression strap. The cover fastening arrangement 29,30,31,32 thus replaces the compression strap(s) which are located opposite compression straps 25 in known compression stuff sacks.

A pair of shoulder straps 33 is attached to body 20 at 34 adjacent buckles 26. Shoulder straps 33 terminate in friction binding return-loop buckles 35. A layer of porous material 36 is sown at its sides and base to side walling 21 and forms a sleeve against the side walling in which shoulder straps 33 can be stowed. Alternatively, in an embodiment not illustrated, shoulder straps 33 can be stowed within the sack by providing slits in the walling proximate the point of attachment of the straps.

Figure 3:
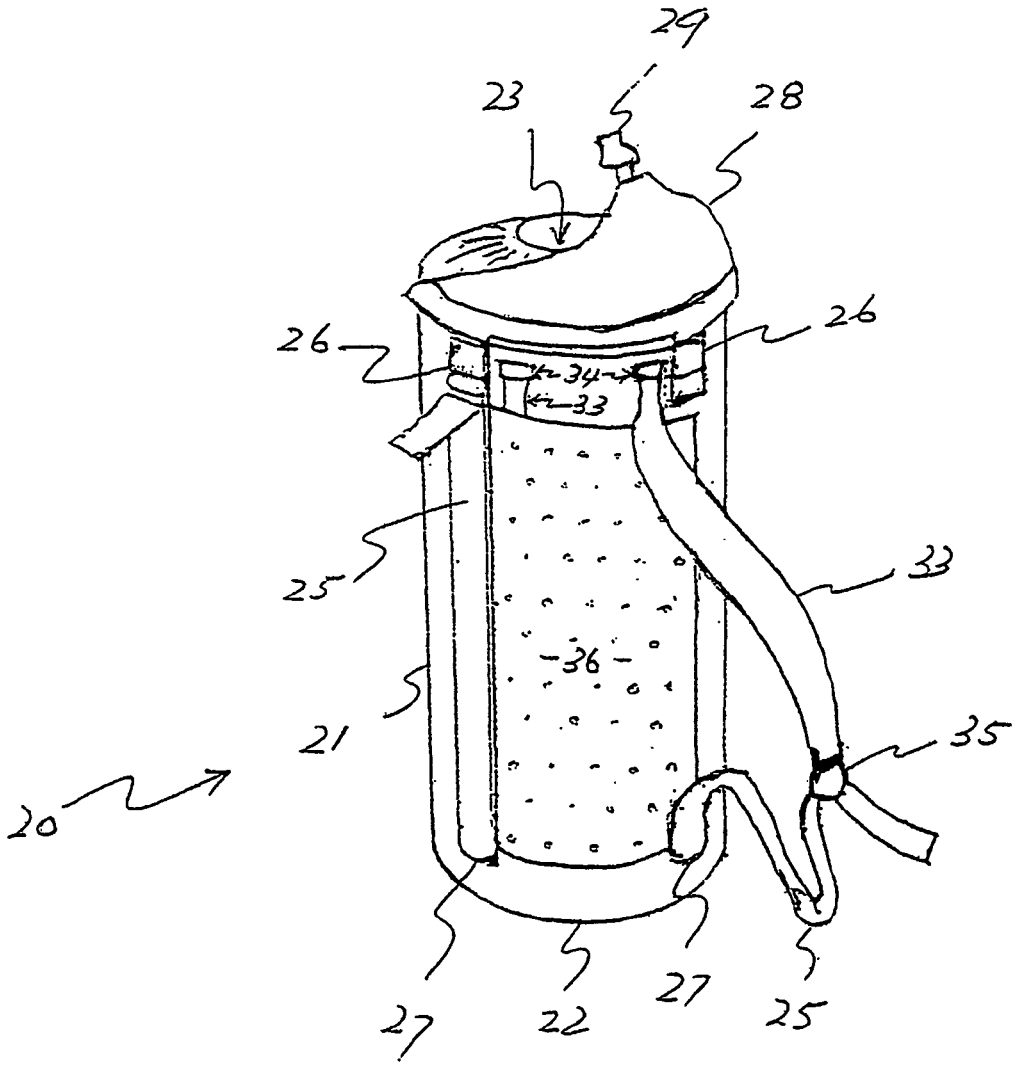
FIG. 3 is a perspective view showing the other side of the sack of the present invention with the cover partially drawn over the sack opening, and one of the shoulder straps withdrawn from its stowed position and connected to a compression strap.
Figure 4:
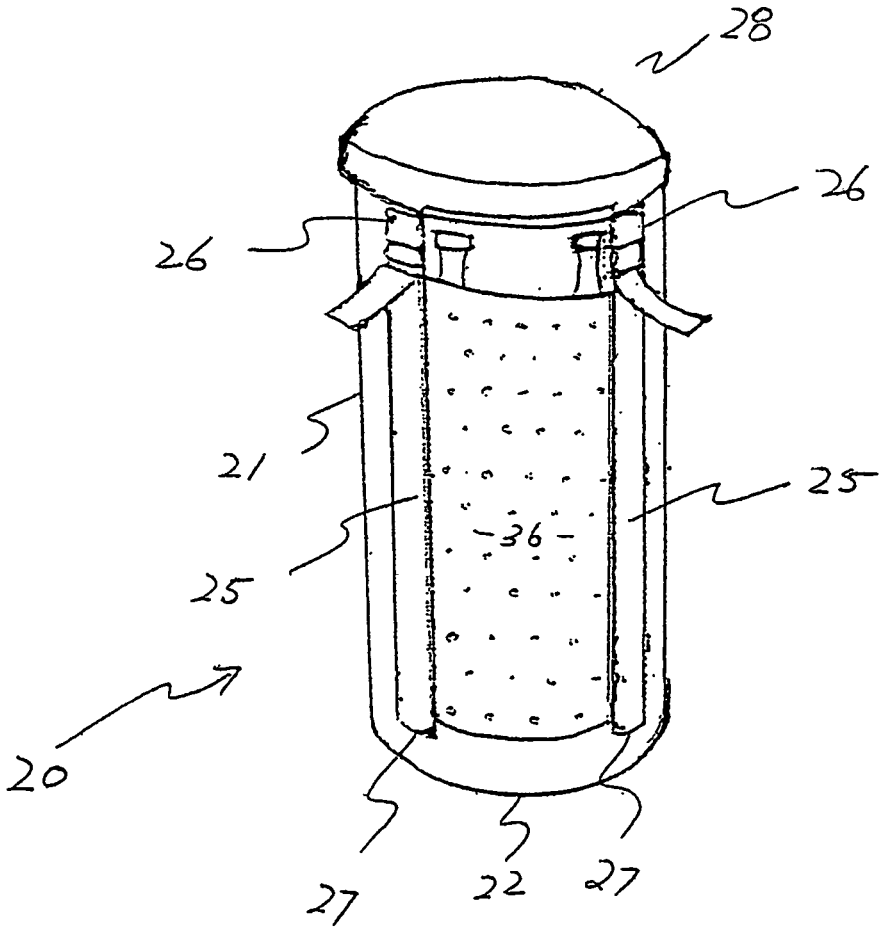
FIG. 4 is a perspective view showing the other side of the sack of the present invention with the cover completely covering the sack opening, and with both shoulder straps in the stowed position.
Figure 5:
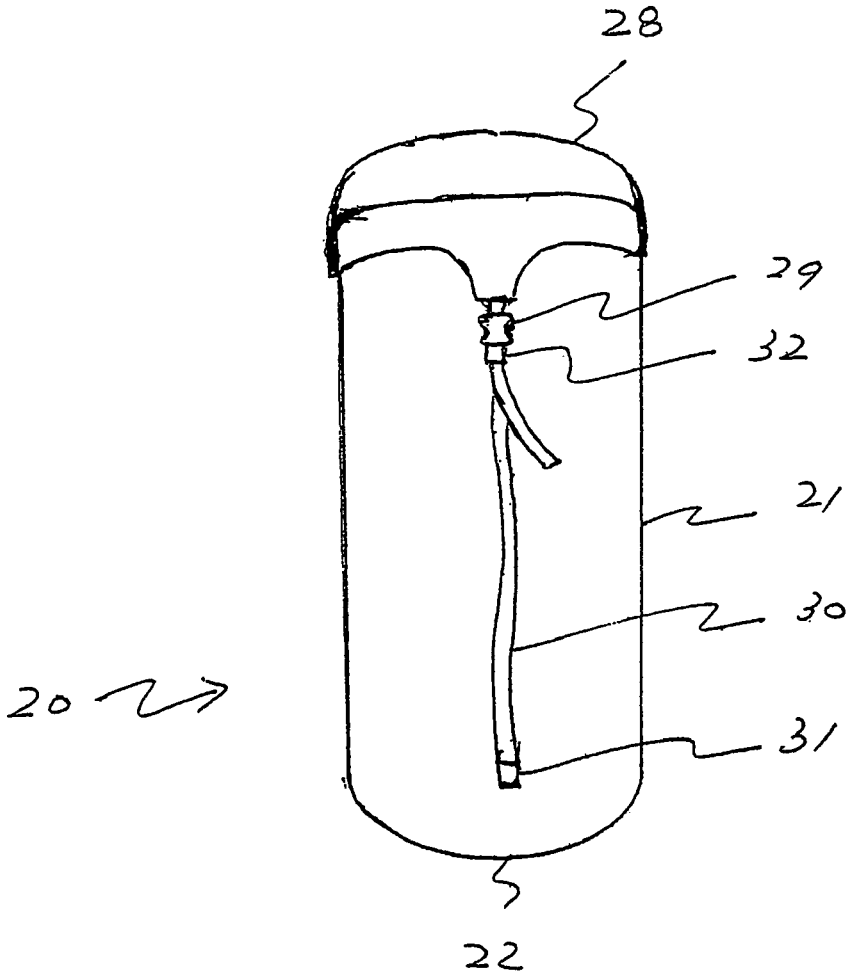
FIG. 5 is a perspective view showing the one side of the sack of the present invention with the cover completely covering the sack opening and the cover fastener connected to the sack.

To use the sack as a light weight backpack, shoulder straps 33 can be removed from the sleeve, the ends of compression straps 25 withdrawn from buckles 26 and passed through buckles 35 as seen with one of straps 25 in FIG. 3. The sleeve acts to form a breathable barrier between the sack and the back of a person using the sack as a backpack, and can also receive a stiffener to provide the backpack with a flatter rather than curved surface to abut the wearer's back. The sleeve can also be used to stow a hydration bladder.

It will be appreciated that the strap, buckle and clip arrangements illustrated are merely exemplary of many suitable alternatives including replacing the straps 25,33 having friction binding return-loop buckles 26,35 with straps having a socket and pronged friction binding return-loop clip arrangement similar to the arrangement 29,30,31,32 illustrated for fastening cover 28. Moreover the connection point of the straps can be reversed from the top/bottom configurations illustrated.

Figure 2:
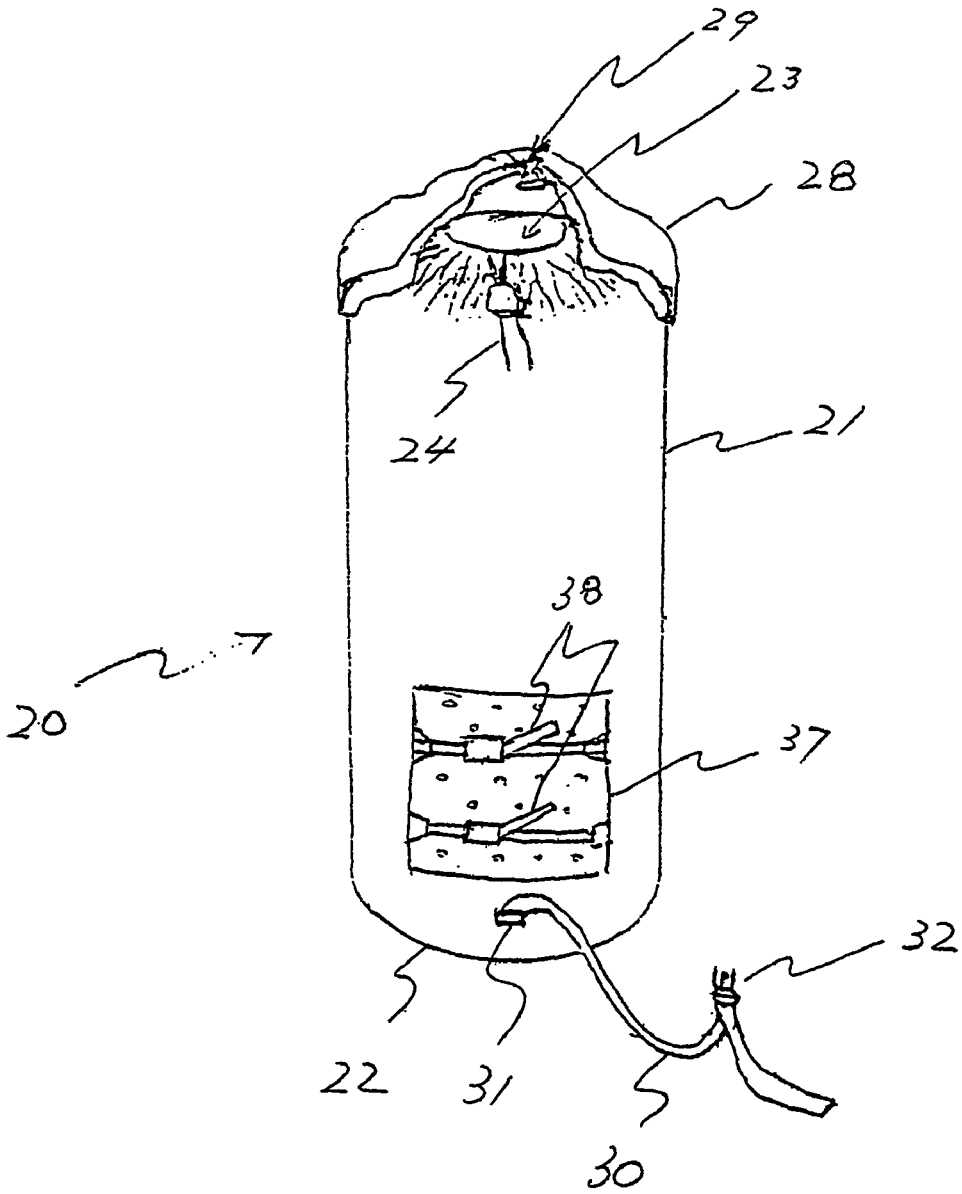
FIG. 2 is a perspective view showing one side of the sack of the present invention with the cover partially drawn over the sack opening and the cover fastener disconnected from the sack.

FIG. 2 illustrates some optional additions which can be included. Another sleeve 37 can be provided on the sack and further circumferentially directed binding compression strap (s) 38 can be provided.

Accordingly, it can be seen that the sack of the present invention is suitable for compressing compressible material contained therein, and has a pliable body portion 20 for receiving the material, the body portion having a lower base portion 22, wall means 21 and an upper opening 23 for introducing the material into the sack and removing it therefrom. The sack also has cover means 28 exterior to body portion 20 which is fixed thereto proximate the opening 23. Cover means 28 has cover fastening means 29,30,32 aligned parallel to the central axis for releasably fastening to body portion 20 proximate base 22 whereby cover means 28 covers opening 23. The sack also has a plurality of straps 25 and/or connectors 26 aligned parallel to the central axis and exterior to body portion 20 and attached thereto at 27. The cover fastening means 29,30 and the plurality of straps 25 and/or connectors 26 are operable to compress material in body portion 20.

In a preferred embodiment of this aspect of the invention the sack has shoulder straps 33 which are cooperable with another or others of the plurality of straps 25 and/or connectors 26 whereby the sack constitutes a backpack.

Similarly it can be seen that the backpack of the other aspect of the present invention has a pliable body portion 20 having a lower base portion 22, wall means 21 and an upper opening 23 for introducing material into the backpack and removing it therefrom. The backpack also has cover means 28 exterior to the body portion which is fixed thereto proximate opening 23. Cover means 28 has cover fastening means 29,30 aligned parallel to the central axis for releasably fastening to body portion 20 proximate base 22 whereby cover means 28 covers opening 23. The backpack also has a plurality of straps 25 and/or connectors 26 aligned parallel to the central axis and exterior to body portion 20 and attached thereto at 27. The backpack also has shoulder straps 33 exterior to body portion 20 and fixed at 34 thereto proximate opening 23. Shoulder straps 33 cooperate in use with at least one of the plurality of straps 25 and/or connectors 26 and are stowable when not in use. Cover fastening means 29,30 and the plurality of straps 25 and/or connectors 26 are operable to compress material in body portion 20.

It will be readily appreciated that the present invention has a number of advantages in comparison with known compression stuff sacks. Moreover it will of course be realised that whilst the above has been given by way of an illustrative example of this invention, all such and other modifications and variations hereto, as would be apparent to persons skilled in the art, are deemed to fall within the broad scope and ambit of this invention as is herein set forth.

The invention claimed is:

1. A sack for compressing compressible material contained therein, the sack including:

a pliable substantially cylindrical body portion extending along a central axis for receiving the material, the body portion having a lower base portion, a substantially cylindrical wall and an upper opening for introducing the material into the sack and removing it therefrom;

a cover exterior to the body portion and fixed thereto proximate the opening and having a cover fastener aligned parallel to the central axis for releasably fastening to the body portion proximate the base whereby the cover covers the opening, a plurality of compression straps aligned parallel to the central axis and connected to the body portion proximate the base and releasably connected with a first set of connectors located proximate the upper opening, the cover fastener and compression straps being operable to compress material in the body portion along the central axis;

a pair of shoulder straps, separate from the compression straps, connected to the wall adjacent two of the first set of connectors and terminating in a second set of connectors, the second set of connectors being connected with the compression straps when the compression straps are not connected with the first set of connectors; and a panel member juxtaposing the wall and attached thereto to constitute a sleeve on the sack, the sleeve configured to stow the shoulder straps between the wall and the panel member when the second set of connectors are not connected with the compression straps.

2. A sack as claimed in claim 1, wherein the upper portion of the wall constitutes the opening and includes a drawstring for the opening.

3. A sack as claimed in claim 2, wherein the cover is cap-like and adapted to cover and extend below the opening when the cover fastener is fastened to the body portion.

4. A sack as claimed in claim 3, wherein the panel member is porous and pliable and constitutes a breathable barrier between the user's back and the sack, the sleeve being adapted to optionally stow a stiffening member or hydration bladder.

5. A backpack including:

a pliable substantially cylindrical body portion extending along a central axis and having a lower base portion, a wall and an upper opening for introducing material into the backpack and removing it therefrom;

a cover exterior to the body portion and fixed thereto proximate the opening and having a cover fastener aligned parallel to the central axis for releasably fastening to the body portion proximate the base whereby the cover covers the opening;

a pair of shoulder straps fixed at one end to the body portion proximate the opening and terminating in a first set of connectors at each free end;

a plurality of compression straps aligned parallel to the central axis and connected at one end to the body proximate the base and releasably connected with the shoulder straps via the first set of connectors a panel member juxtaposing the wall and attached thereto to constitute a sleeve on the back of the sack, the sleeve adapted to optionally stow the shoulder straps between the wall and the panel member when the compression straps are not connected with the first set of connectors; and a second set of connectors located proximate the upper opening and connected with the compressions straps when the compression straps are not connected with the shoulder straps, the compressions straps and the second set of connectors being operable with the cover fastener to compress material in the body portion along the central axis.

6. A backpack as claimed in claim 5, wherein the panel member is porous and pliable and constitutes a breathable barrier between the user's back and the backpack, the sleeve being adapted to optionally stow a stiffening member or hydration bladder.

* * * * *